US009815069B2

(12) United States Patent
Hou et al.

(10) Patent No.: US 9,815,069 B2
(45) Date of Patent: Nov. 14, 2017

(54) SHOWER HEAD WITH A ROTARY BOTTOM COVER ASSEMBLY

(71) Applicant: Xiamen Runner Industrial Corporation, Xiamen (CN)

(72) Inventors: Lei Hou, Xiamen (CN); Yu-Ping Zhang, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 15/261,233

(22) Filed: Sep. 9, 2016

(65) Prior Publication Data

US 2017/0087565 A1 Mar. 30, 2017

(30) Foreign Application Priority Data

Sep. 26, 2015 (CN) ..... 2015 2 0751189 U

(51) Int. Cl.
*B05B 3/04* (2006.01)
*B05B 1/18* (2006.01)
*B05B 15/06* (2006.01)

(52) U.S. Cl.
CPC ..... *B05B 1/185* (2013.01); *B05B 3/04* (2013.01); *B05B 3/0418* (2013.01); *B05B 15/067* (2013.01)

(58) Field of Classification Search
CPC ..... B05B 1/185; B05B 3/02; B05B 3/0409; B05B 3/0463; B05B 3/0495; B05B 15/067
USPC ..... 239/548, 240
See application file for complete search history.

(56) References Cited

U.S. PATENT DOCUMENTS 2,878,066 A * 3/1959 Erwin ..... B05B 1/3426 239/381
3,762,648 A * 10/1973 Deines ..... B05B 1/1636 239/381
3,963,179 A * 6/1976 Tomaro ..... B05B 1/1636 239/101
3,967,783 A * 7/1976 Halsted ..... B05B 1/1663 239/381
4,081,135 A * 3/1978 Tomaro ..... B05B 1/1636 239/381
4,117,979 A * 10/1978 Lagarelli ..... B05B 1/1681 239/381
4,141,502 A * 2/1979 Grohe ..... B05B 3/04 239/381
4,187,986 A * 2/1980 Petrovic ..... B05B 1/1681 239/449

(Continued)

*Primary Examiner* — Viet Le
(74) *Attorney, Agent, or Firm* — Chun-Ming Shih

(57) ABSTRACT

A shower head with rotary bottom cover assembly includes a water passage member with a third inlet and an outlet chamber communicating with each other, a rotator mounted inside the outlet chamber and having a first rotator inlet, a first outlet and a diverting channel, a rotator cover, a bottom cover assembly. The first rotator inlet is mounted inside the third inlet of the water passage member and communicates with a center portion of the diverting channel. The diverting channel has two second outlets formed on two ends thereof and oppositely located. The rotator cover hermetically covers and seals the outlet chamber and has a hole for an outlet hose to be mounted through. A top of the outlet hose is connected with the center portion of the diverting channel. A bottom of the outlet hose engages the bottom cover assembly. The water head is structurally simple and has massaging effect.

7 Claims, 3 Drawing Sheets

(56) References Cited

U.S. PATENT DOCUMENTS 4,203,550 A * 5/1980 On ..... B05B 1/1654 239/381
4,209,132 A * 6/1980 Kwan ..... A61H 23/04 239/381
4,219,160 A * 8/1980 Allred, Jr. ..... B05B 1/18 239/447
4,239,409 A * 12/1980 Osrow ..... A46B 13/06 401/281
4,303,201 A * 12/1981 Elkins ..... B05B 1/1636 239/381
4,330,089 A * 5/1982 Finkbeiner ..... B05B 1/1681 239/381
4,346,844 A * 8/1982 Harmony ..... B05B 1/1636 239/381
4,427,074 A * 1/1984 Wollin ..... A62C 3/0207 169/46
4,478,367 A * 10/1984 Petursson ..... B05B 1/1636 239/381
4,616,298 A * 10/1986 Bolson ..... A62C 37/08 290/54
4,629,125 A * 12/1986 Liu ..... B05B 1/1636 239/383
4,801,091 A * 1/1989 Sandvik ..... B05B 3/04 239/381
5,056,715 A * 10/1991 Korsmeyer ..... B01F 7/00775 118/303
5,090,624 A * 2/1992 Rogers ..... B05B 1/1645 239/381
5,129,121 A * 7/1992 Gelman ..... A46B 13/06 15/29
5,201,468 A * 4/1993 Freier ..... B05B 1/1654 239/383
5,230,106 A * 7/1993 Henkin ..... A61H 33/0087 4/541.4
5,294,054 A * 3/1994 Benedict ..... B05B 1/1645 239/222.15
5,316,216 A * 5/1994 Cammack ..... B05B 1/1636 239/381
5,397,064 A * 3/1995 Heitzman ..... B05B 1/1636 239/101
5,765,760 A * 6/1998 Kuo ..... B05B 1/1654 239/437
6,076,743 A * 6/2000 Fan ..... B05B 1/1636 239/381
6,230,989 B1 * 5/2001 Haverstraw ..... B05B 1/044 239/443
6,276,614 B1 * 8/2001 Huang ..... B05B 3/04 239/222.17
6,715,699 B1 * 4/2004 Greenberg ..... B05B 1/1645 239/383
6,908,047 B2 * 6/2005 Saunders ..... B05B 3/16 239/225.1
7,111,795 B2 * 9/2006 Thong ..... B05B 1/1636 239/222.15
8,297,534 B2 * 10/2012 Li ..... B05B 1/1654 239/222.11
9,108,206 B1 * 8/2015 Bredberg ..... B05B 3/0427
9,227,207 B1 * 1/2016 Bredberg ..... A01G 25/00
9,404,243 B2 * 8/2016 Cacka ..... B05B 1/1654
9,631,348 B2 * 4/2017 Huang ..... E03C 1/0408
2005/0061896 A1 * 3/2005 Luettgen ..... B05B 1/1654 239/449
2006/0076436 A1 * 4/2006 Zhadanov ..... B05B 1/1627 239/383
2006/0102747 A1 * 5/2006 Ho ..... B05B 1/18 239/383
2006/0138253 A1 * 6/2006 Petrovic ..... B05B 1/1609 239/446
2006/0144968 A1 * 7/2006 Lev ..... B05B 1/18 239/590
2006/0196971 A1 * 9/2006 Lau ..... B05B 1/18 239/436
2007/0205309 A1 * 9/2007 Zhou ..... B05B 3/0427 239/587.1
2008/0098512 A1 * 5/2008 Fang ..... A61H 7/005 4/615
2009/0159724 A1 * 6/2009 Kacik ..... B05B 1/18 239/383
2010/0065665 A1 * 3/2010 Whitaker ..... B05B 1/1636 239/562
2010/0127096 A1 * 5/2010 Leber ..... B05B 3/04 239/101
2012/0181353 A1 * 7/2012 Zhou ..... A61H 9/0021 239/101
2012/0205465 A1 * 8/2012 Kah, Jr. ..... B05B 3/045 239/240
2013/0032231 A1 * 2/2013 Stein ..... E03C 1/084 137/561 R
2014/0332608 A1 * 11/2014 Harwanko ..... B05B 1/185 239/553.5
2015/0343463 A1 * 12/2015 Chan ..... B05B 1/1636 239/447
2015/0367355 A1 * 12/2015 Komaki ..... B05B 1/185 239/381
2016/0107175 A1 * 4/2016 Kinle ..... B05B 1/185 239/437
2016/0228887 A1 * 8/2016 Lin ..... B05B 3/0463
2016/0296950 A1 * 10/2016 Tian ..... B05B 1/18
2016/0303587 A1 * 10/2016 Zhou ..... B05B 3/04
2017/0050197 A1 * 2/2017 Huffington ..... B05B 1/185
2017/0087565 A1 * 3/2017 Hou ..... B05B 1/185

* cited by examiner

SHOWER HEAD WITH A ROTARY BOTTOM COVER ASSEMBLY

BACKGROUND OF THE INVENTION

Field of the Invention

The present invention relates to a shower head and, more particularly, to a shower head with a rotary bottom cover assembly.

Description of The Related Art

Conventional shower heads are regular bathroom accessories, which are generally classified into hand-held shower heads, rain shower heads and massage shower heads. The spray patterns of the shower heads have multiple types, including normal spray, pure spray, massage spray, rain spray and so on for users to choose from. The massage spray takes the form of intermittent water output and intermittently hits on human bodies for users to perceive high and low water pressure thereon. As the water flow of the massage spray is perceivably soft and comfortable water, many people are therefore fond of the massage spray.

However, as the massage shower heads come with impeller to implement intermittent water output, have numerous parts and limited water output range, and are structurally complicated and space-taking, less favorable word of mouth arises from users' experience with the massage shower heads.

SUMMARY OF THE INVENTION

In view of the problems and drawbacks of the prior art, the objective of the present invention is to provides a shower head with a rotary bottom cover assembly being structurally simple and having massaging effect.

To achieve the foregoing objective, the shower head with a rotary bottom cover assembly includes a housing, a water passage member, a rotator, a rotator cover and a bottom cover assembly.

The housing is hollow.

The water passage member is mounted into the housing, and has a third inlet and an outlet chamber.

The ball joint is mounted into the third inlet of the water passage member, and has a top end and a bottom end.

The top end has a first inlet adapted to be connected with a water hose.

The bottom end has an outlet.

The rotator is cross-shape and is mounted into the outlet chamber of the water passage member, and has a top end and a bottom end.

The top end has a first rotator inlet.

The bottom end has an outlet.

The diverting channel is horizontally formed in the rotator, and has two second outlets and a second inlet.

The two second outlets are formed on two ends of the diverting channel.

The second inlet is formed in the rotator, is located under the diverting channel, and communicates with the first outlet.

The rotator cover is mounted inside the housing and has a hole. The first outlet of the rotator is mounted through the hole, and an edge of the rotator cover is connected with an edge portion of the water passage member.

The bottom cover assembly is mounted on a bottom portion of the housing, is connected with the rotator, and has a first cover, a second cover and a decorative cover.

The first cover has a hole centrally formed through the first cover and being internally-threaded. The first outlet of the rotator engages the hole through threaded connection.

The second cover has multiple nozzles for water to flow out, and a chamber is defined between the first cover and the second cover.

The decorative cover has multiple holes, and the nozzles of the second cover is respectively mounted through the holes of the decorative cover.

According to the foregoing description, the shower head utilizes a self-rotating rotator to drive the bottom cover assembly to rotate and generate a desired form of water spray for the purpose of massaging effects. Besides, the simple structure of the shower head ensures longer life span, smaller start-up pressure, moreover, smooth operation, and has the desired form of water spray and massaging effect.

BRIEF DESCRIPTION OF THE DRAWINGS

The detailed description of the drawings particularly refers to the accompanying figures in which.

DETAILED DESCRIPTION OF THE INVENTION

The purpose, construction, features, functions and advantages of the present invention can be appreciated and understood more thoroughly through the following detailed description with reference to the attached drawings.

Figure 1:
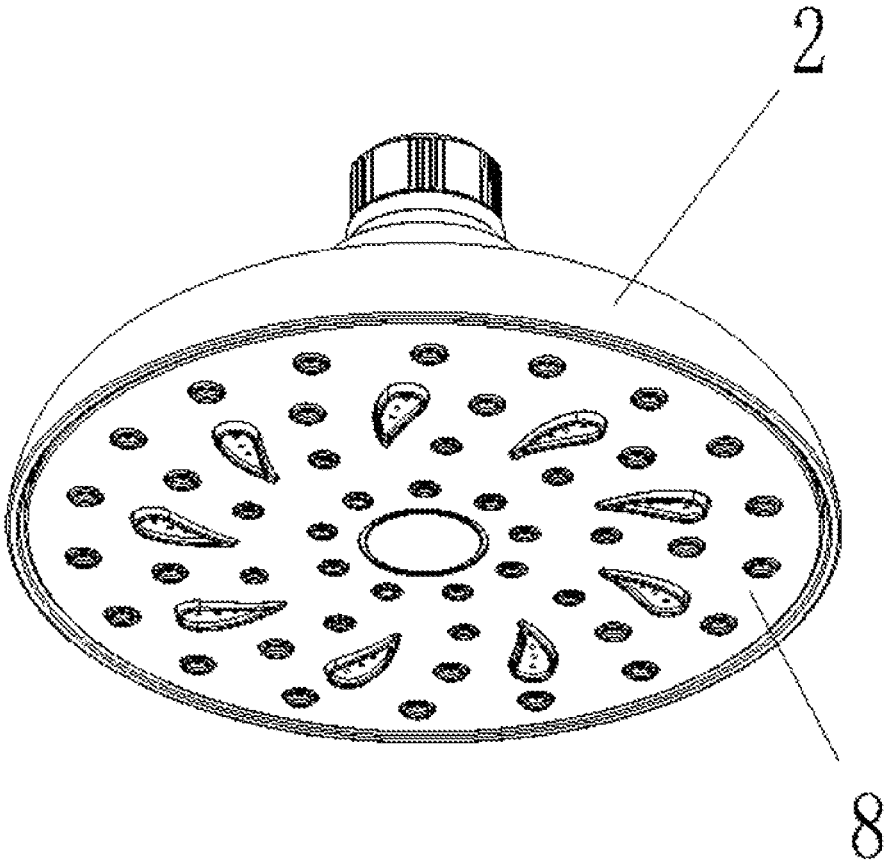
FIG. 1 is a perspective view of a shower head with a rotary bottom cover assembly in accordance with the present invention.
Figure 2:
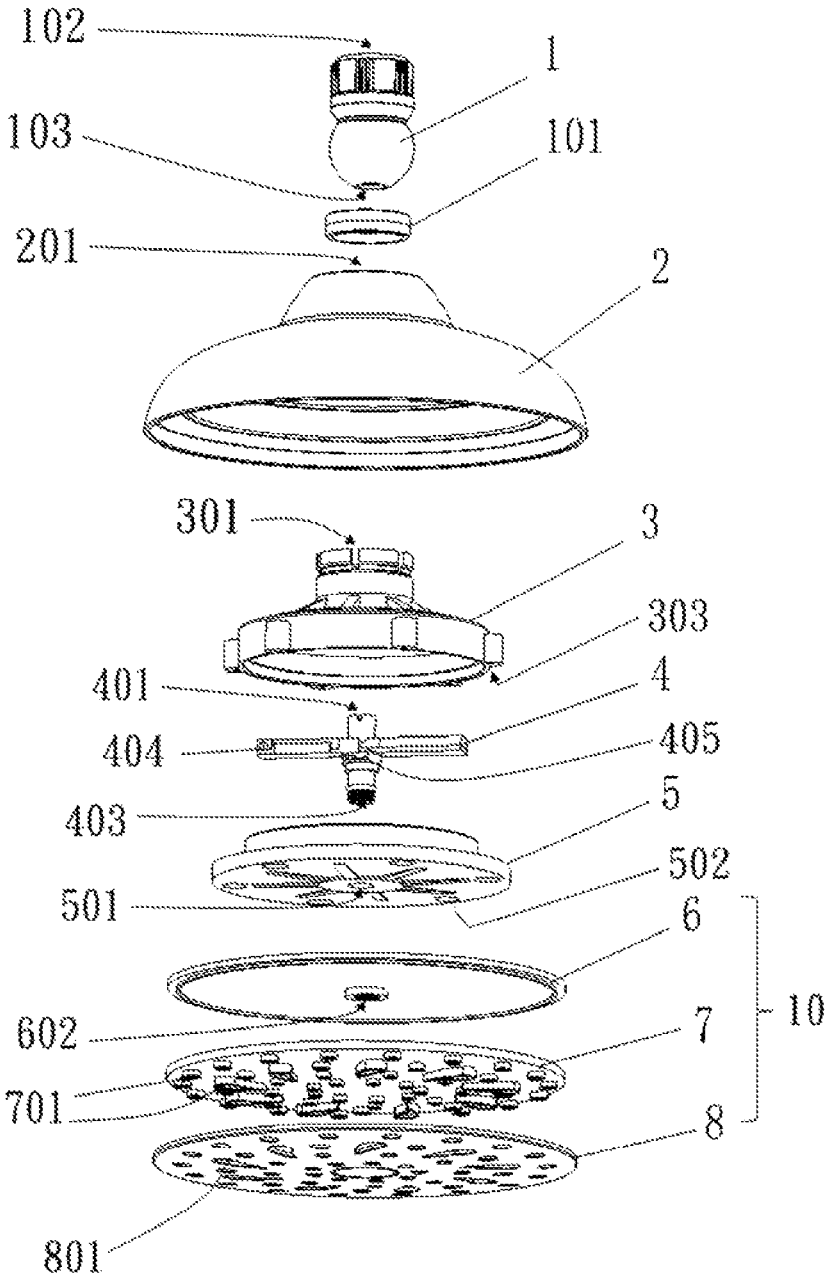
FIG. 2 is an exploded perspective view of the shower head with a rotary bottom cover assembly in FIG. 1.
Figure 3:
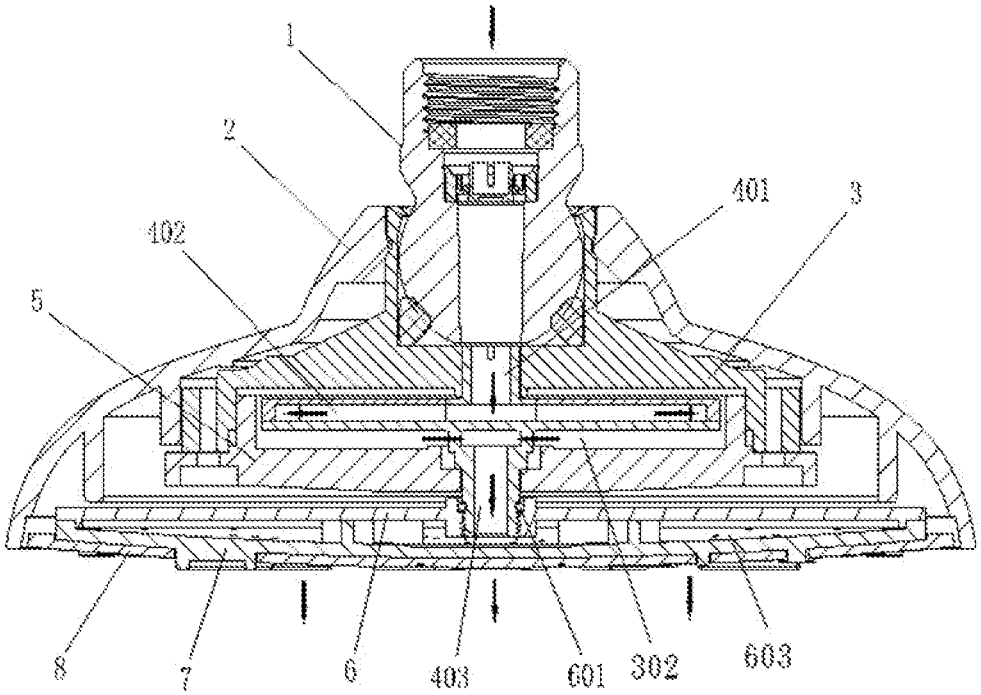
FIG. 3 is a cross-sectional view of the shower head with a rotary bottom cover assembly in FIG. 1.

With reference to FIGS. 1-3, a shower head with rotary bottom cover assembly in accordance with the present invention includes a ball joint 1, a housing 2, a water passage member 3, a rotator 4, a rotator cover 5, a first cover 6, a second cover 7 and a decorative cover 8.

The housing 2 is hollow and has a top portion and a bottom portion. The top portion of the housing 2 has a second inlet 201 formed through the top portion.

The water passage member 3 is hollow, is mounted into the housing 2, and has a third inlet 301, an outlet chamber 302 and multiple connection holes 303. The third inlet 301 is mounted inside the second inlet 201 of the housing 2. The connection holes 303 are formed on a peripheral wall of the water passage member 3.

The ball joint 1 is mounted inside the third inlet 301 of the water passage member 3 and has a top end and a bottom end. The top end has a first inlet 102 connected with a water hose, and the bottom end has an outlet 103 mounted into the third inlet 301 of the water passage member 3 through an O-ring 101 to form a watertight seal.

The rotator 4 is cross-shape and is mounted into the outlet chamber 302 of the water passage member 3. The rotator 4 has a top end and a bottom end, the top end has a first rotator inlet 401, and the bottom end has a first outlet 403. The rotator 4 further has a diverting channel 402 horizontally formed in the rotator 4. The diverting channel 402 has two second outlets 404 formed in two ends of the diverting channel 402 to communicate with the diverting channel 402, and openings of the second outlets 404 face opposite directions. A second inlet 405 is formed in the rotator 4, is located under the diverting channel 402, and communicates with the first outlet 403. The first rotator inlet 401 is connected with the outlet 103 of the ball joint 1. A peripheral wall of the first outlet 403 is externally threaded.

The rotator cover 5 is mounted inside the housing 2 and has a hole 501 formed through the rotator cover 5, and the first outlet 403 of rotator 4 is mounted through the hole 501. The rotator cover 5 has multiple connection holes 502 formed through an edge portion of the rotator cover 5. Each connection hole 502 is connected with one of the connection holes 303 of the water passage member 3 through a connection element, such that the rotator 4 is mounted inside the outlet chamber 302 to simultaneously rotate with the water passage member 3. The connection elements may be nails or screws.

The first cover 6, the second cover 7 and the decorative cover 8 constitutes a bottom cover assembly 10. The bottom cover assembly 10 is mounted on the bottom portion of the housing 2 to hold the water passage member 3, rotator 4, rotator cover 5 inside the housing 2. The first cover 6 has a hole 602 centrally formed through the first cover 6 and being internally-threaded, and engaging the outlet 403 of the rotator 4 through threaded connection, and a seal ring 601 is hermetically mounted between the hole 602 of the first cover 6 and the first outlet 403 of rotator 4.

With reference to FIGS. 2 and 3, a chamber 603 is defined between the first cover 6 and the second cover 7. The second cover 7 has multiple nozzles 701 for water to flow out. The decorative cover 8 has multiple holes 801, and the nozzles 701 of the second cover 7 are respectively mounted through the holes 801 of the decorative cover 8.

Operation of the shower head with rotary bottom cover assembly is described as follows. Water flows into the shower head through the first inlet 102 of the ball joint 1, flows into the rotator 4 through the first rotator inlet 401, further enters the diverting channel 402 and flows out the rotator 4 through the second outlets 404. As the second outlets 404 of the rotator 4 are oppositely arranged, water flowing out the rotator 4 through the second outlets 404 generates two opposite forces driving the rotator 4 to rotate automatically.

After the outlet chamber 302 is fully filled with water flowing out of the second outlet 404, spilled water then flows into the rotator 4 through the second inlet 405, enters the chamber 603 between the first cover 6 and the second cover 7 through the first outlet 403, and finally flows out of the bottom cover assembly 10 through the nozzles 701 of the second cover 7.

When the rotator 4 is rotated to drive the bottom cover assembly 10 to rotate, water spray out of the shower head has twisting and massaging effect. As the tightening direction of the bottom cover assembly 10 is the opposite as rotation direction of the rotator 4, the bottom cover assembly 10 won't be separated from the rotator 4.

What is claimed is:

1. A shower head with a rotary bottom cover assembly, comprising:

a housing being hollow;

a water passage member mounted into the housing, and having a third inlet and an outlet chamber;

a ball joint mounted into the third inlet of the water passage member, and having:

a top end having a first inlet adapted to be connected with a water hose; and a bottom end having an outlet;

a rotator being cross-shape and mounted into the outlet chamber of the water passage member, and having:

a top end having a first rotator inlet; and a bottom end having an outlet; and a diverting channel horizontally formed in the rotator, and having:

two second outlets formed on two ends of the diverting channel; and a second inlet formed in the rotator, located under the diverting channel, and communicating with the first outlet;

a rotator cover mounted inside the housing and having a hole, wherein the first outlet of the rotator is mounted through the hole, an outlet chamber is defined between the rotator cover and the water passage member, and an edge of the rotator cover is connected with an edge portion of the water passage member; and a bottom cover assembly mounted on a bottom portion of the housing, connected with the rotator, having a first cover, a second cover and a decorative cover, the rotator is rotated to drive the bottom cover assembly to rotate, and water spray out of the shower head.

2. The shower head as claimed in claim 1, wherein the first cover has a hole centrally formed through the first cover and being internally-threaded, and the first outlet of the rotator engages the hole through threaded connection;

the second cover has multiple nozzles for water to flow out, wherein a chamber is defined between the first cover and the second cover; and the decorative cover has multiple holes, wherein the nozzles of the second cover are respectively mounted through the holes of the decorative cover.

3. The shower head as claimed in claim 1, wherein the bottom end of the ball joint is mounted into the third inlet of the water passage member through an O-ring, and the outlet of the ball joint is connected with the first rotator inlet of the rotator.

4. The shower head as claimed in claim 1, wherein water flows into the shower head through the first inlet of the ball joint, flows into the rotator through the first rotator inlet, further enters the diverting channel, and flows out the rotator through the second outlets, and after the outlet chamber is fully filled with water flowing out of the second outlet, spilled water flows into the rotator through the second inlet, enters the chamber between the first cover and the second cover through the first outlet of the rotator, and finally flows out of the bottom cover assembly through the nozzles of the second cover.

5. The shower head as claimed in claim 2, wherein water flows into the shower head through the first inlet of the ball joint, flows into the rotator through the first rotator inlet, further enters the diverting channel, and flows out the rotator through the second outlets, and after the outlet chamber is fully filled with water flowing out of the second outlet, spilled water flows into the rotator through the second inlet, enters the chamber between the first cover and the second cover through the first outlet of the rotator, and finally flows out of the bottom cover assembly through the nozzles of the second cover.

6. The shower head as claimed in claim 1, wherein the second outlets of the rotator are oppositely arranged, water flowing out the rotator through the second outlets generates two opposite forces driving the rotator to rotate automatically, and the rotating rotator drives the bottom cover assembly to rotate, and the tightening direction of the bottom cover assembly is the same as rotation direction of the rotator.

7. The shower head as claimed in claim 1, wherein a seal ring is hermetically mounted between the hole of the first cover and the first outlet of rotator.

* * * * *